US006473039B1

(12) United States Patent
Whybrew et al.

(10) Patent No.: US 6,473,039 B1
(45) Date of Patent: Oct. 29, 2002

(54) SLOPPY COAX INTERCONNECT FOR LOW COST RF AND PHASED ARRAY APPLICATIONS

(76) Inventors: Walter M. Whybrew, 957 Beacon St. NW., Palm Bay, FL (US) 32907-7836; William E. Clark, 401 Hyder St., NE., Palm Bay, FL (US) 32907; Jay Warshowsky, 403 Andrews Dr., Melbourne, FL (US) 32951; Vincent G. Karasack, 901 Wilshire Ct., Melbourne, FL (US) 32940; Joey Sartin, 1514 Creel Rd. NE., Palm Bay, FL (US) 32905; George Harrison, 108 S. 12th St., Flogler Beach, FL (US) 32136

( * ) Notice: Subject to any disclaimer, the term of this patent is extended or adjusted under 35 U.S.C. 154(b) by 0 days.

(21) Appl. No.: 09/386,374

(22) Filed: Aug. 31, 1999

(51) Int. Cl.[7] ..... H01Q 1/38; H01P 3/06; H01P 1/04

(52) U.S. Cl. ..... 343/700 MS; 343/853; 333/245; 333/243; 333/260

(58) Field of Search ..... 333/243, 244, 333/245, 260; 343/700 MS, 853

(56) References Cited

U.S. PATENT DOCUMENTS 4,641,140 A * 2/1987 Heckaman et al. ..... 333/243 X
4,695,810 A * 9/1987 Heckaman et al. ..... 333/243 X
4,995,815 A * 2/1991 Buchanan et al. ..... 333/260 X
5,703,599 A * 12/1997 Quan et al. ..... 333/260 X

* cited by examiner

*Primary Examiner*—Benny T. Lee
(74) *Attorney, Agent, or Firm*—Duane Morris LLP

(57) ABSTRACT

An interconnect device for connecting components of high frequency communication systems, including RF and phased array applications. The device is capable of carrying RF and microwave signals between pairs of components and includes an outer conducting tube and an insulated conducting wire disposed within the tube. The outside diameter of the insulated wire is less than the inside diameter of the tube allowing movement of the wire relative to the tube. As a result of this movement, the longitudinal axis of the wire may vary from the longitudinal axis of the tube resulting in a "sloppy coax" interconnect. The ability of the wire to move within the tube facilitates installation and replacement of the wire when required.

43 Claims, 7 Drawing Sheets

SLOPPY COAX INTERCONNECT FOR LOW COST RF AND PHASED ARRAY APPLICATIONS

BACKGROUND OF THE INVENTION

The present invention is related to the connection of components in high frequency communication systems and, more particularly, to an interconnect device for RF and phased array applications.

RF and phased array systems include many different components. For example, a phased array system typically includes a plurality of antenna elements and modules. The modules may contain, for example, signal polarizers, amplifiers and phase shifters. The systems require that these components be connected together, so that, the signal may be passed between components. The device used to connect the components is typically referred to as an interconnect.

Currently, several different interconnects are in use. Some systems utilize a simple coaxial cable. The cable includes coaxial connectors at each end for connecting to the electrical components. These connectors typically take the form of SMA or GPO connectors. However, the use of coaxial cables for interconnects has certain drawbacks. The cables are heavy and at times exhibit degraded RF performance. Furthermore, the use of cables limit the density of the elements in the array. Current phased array system requirements demand an increase in the number of antenna elements within a given area. The bulky coaxial cables and the associated connectors limit the amount of antenna elements that may be placed in a given array.

In other systems, connections are made directly between components without the size of the cables. Each component includes a typical connector (e.g., General Purpose Outlets ("GPO") or Subminature-A ("SMA")) adapted to be attached to a similar connector located on the other component to be connected to. The use of a direct connection requires that the two components being connected be coaxial aligned. This constraint on positioning further limits the available configurations of components and performance of the system.

Other systems include coaxial cables without end connectors. In these systems, the cables are typically soldered to the components. These systems may avoid the drawbacks associated with the use of connectors however, heavy and bulky cables are still required.

Still other systems in use do not include coaxial cables or connectors. These systems require more complicated elements to attach the components together. These elements may often include, for example, jumpers, bridges and ribbon/wire bonds. An interconnect of this type typically has a complex design specifically tailored for the configuration of a particular system. The assembly, rework and repair processes are quite difficult due to the complex connections. Furthermore, RF performance is typically degraded by the use of these elements.

All of the current interconnect devices are difficult to rework or repair. Currently, there are no simple procedures associated with replacing a failed interconnect device. Rework and repair typically requires major disassembly and reassembly.

As discussed above, current interconnect devices have many shortcomings. It is an object of the present invention to obviate many of these shortcomings and to provide a novel interconnect device and method.

It is an object of the present invention to provide a novel interconnect device and method that may be easily manufactured, assembled, and repaired.

It is another object of the present invention to provide a novel interconnect device and method that permits the optimal geometric orientation and density of components to be employed by supporting interconnection between non-planar, non-parallel and/or nonorthogonal components.

It is yet another object of the present invention to provide a novel interconnect device and method that exhibits high performance requirements regardless of the geometric configuration of the components to be connected.

It is still another object of the present invention to provide a novel interconnect device and method applicable to a variety of RF applications.

It is a further object of the present invention to provide a novel interconnect device and method that meets microwave frequency performance requirements.

It is yet a further object of the present invention to provide a novel interconnect device and method that provides consistent performance for each interconnection made.

It is still a further object of the present invention to provide a novel interconnect device and method that is lightweight in order to support space based applications.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
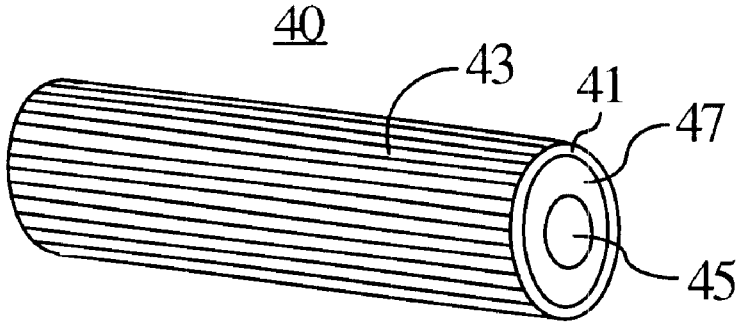
FIG. 1 is a pictorial view of an interconnect device according to the present invention.

In the figures, like numerical designations indicate identical elements on all figures. The interconnect device 40 of the present invention, as shown in FIG. 1, may include an outer tube 43, a conducting wire 45 and a layer of insulator 47. The outer tube 43 is conductive and is formed from a light weight conductive material such as aluminum or copper. A light weight interconnect is preferred due to its potential use in several space based applications. The conducting wire 45 may be any suitable conductor such as, for example, copper or gold. The wire 45 is coated with an insulator 47. The insulator 47 may be formed from a suitable conventional dielectric material, such as TEFLON (i.e. polytetrafluoroethylene (PTFE)).

Figure 2:
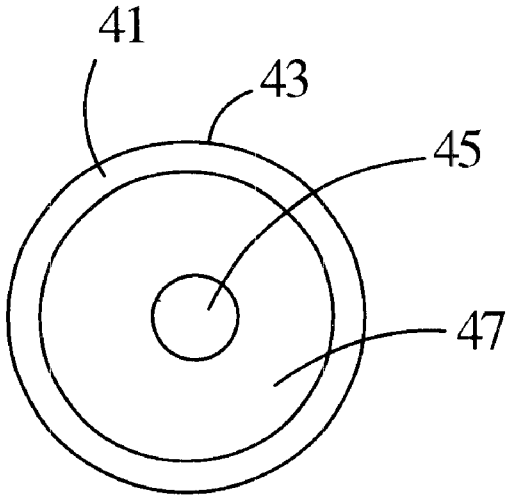
FIG. 2 is an end view of the interconnect device of FIG. 1.

The outer diameter of the insulated coating 47 is less than the inner diameter of the conducting tube 43. As a result, a gap or space 41 is present between the inside of the tube 43 and the insulated wire 47. As shown in FIG. 2, the difference in diameter permits the axis of the insulation 47 and wire 45 to deviate from the axis of the tube 43. The tube 43 and wire 45 are not coaxial but, may be said to have "sloppy" or approximate coaxial relationship. The gap 41 permits the insulated wire 45 to be inserted and removed from the tube 43 with relative ease. TEFLON is preferred for use as insulator 47 due to its relatively smooth surface. While the interconnect 40 has been discussed with reference to a tube with a cylindrical cross-section, the tube cross-section may be modified to suit the particular system design.

The interconnect device 40 described above, may be employed in a wide range of systems. These systems include, for example, phased array antenna structures, communication payload RF electronics, radar electronics and other wireless communications. The frequency carried by the interconnect may exceed 20 GHz and may range up to the cut-off frequency of the tube size chosen. In a phased array RF system the interconnect may typically carry a signal of approximately 26 GHz.

Figure 3:
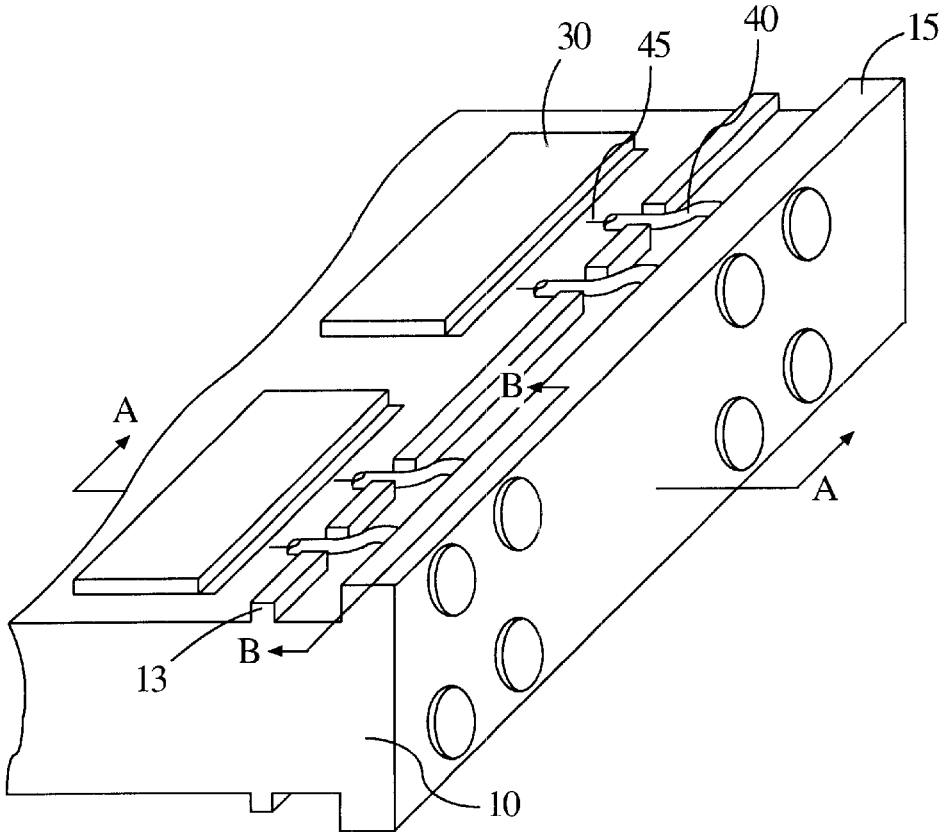
FIG. 3 is pictorial view of a tray containing antenna elements and modules connected by interconnect devices according to the first embodiment of the present invention.

The interconnect device 40 according to the present invention may be used with a RF phased array antenna system, as depicted in FIG. 3. The system includes a plurality of antenna elements 20 and RF modules 30 mounted on a support tray or housing 10. As described above, the modules 30 may perform numerous functions such as signal amplification and polarization. The entire system typically includes a plurality of trays 10 in a stacked configuration. The trays are typically formed from a suitable high strength and light weight material such as aluminum or aluminum beryllium.

The antenna elements 20 may be connected to the modules 30 through the use of the interconnect device 40, as disclosed in FIG. 3. Interconnect 40 includes a conducting wire 45 with an insulator 47. (See FIG. 1) The tube may have an outside diameter of between about 31–37 mils and an inside diameter of between about 23–29 mils. The dielectric layer may have an outside diameter of between about 18–22 mils. The conducting wire may have a diameter of between about 6–10 mils. The dimensions of the elements of the interconnect 40 may be modified to suit the particular use. In a preferred embodiment, the outer tube 43 has an outside diameter of 34 mils and an inside diameter of 26 mils. The outside diameter of the insulated wire is approximately 20 mils. The conducting wire has a diameter of 8 mils.

Figure 4:
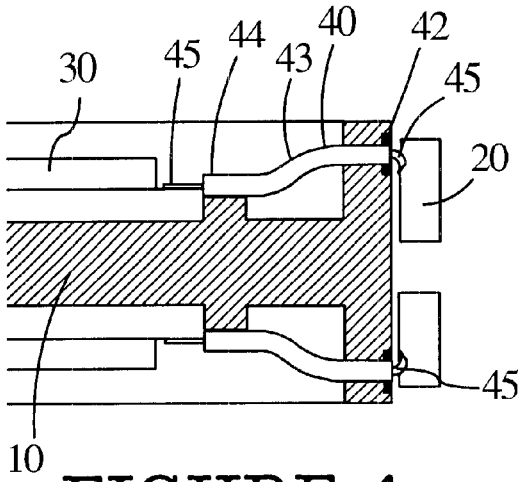
FIG. 4 is a cross-sectional view taken through lines A—A of FIG. 3, showing the first embodiment of the interconnect device.

The interconnect device 40 may be secured to the tray 10, as shown in FIG. 4. The tray 10 is constructed to include ridges 13 and 15, see FIG. 3, to provide support to the device 40. The ends 42, 44 of the tube 43 may be secured to the ridges 13, 15 of the tray 10 by brazing or other suitable procedure. The brazing operation may adversely affect the layer of insulation 47 surrounding the wire 45. As a result, the outer rube 43 is typically mounted to the tray 10 prior to the insertion of the insulated wire 45. As described above, the "sloppy coax" design of the interconnect 40 permits the insulated wire 45 to slide easily into the tube 43.

Figure 5:
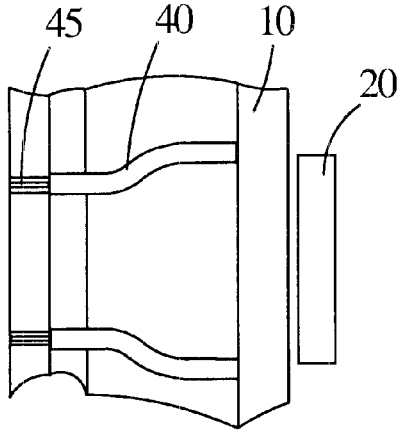
FIG. 5 is a partial view of FIG. 3, showing the first embodiment of the interconnect device.
Figure 6:
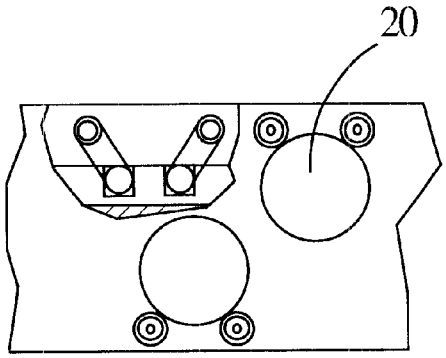
FIG. 6 is an end view of the system of FIG. 3, including a partial cutaway, showing antenna elements and the first embodiment of the interconnect device.

The tube 43 may be preformed to suit the dimensions required by the tray 10. The ends 42, 44 of the tube may have different spatial coordinates in all three dimensions, as shown in FIGS. 5 and 6. The tube may be bent as required to support the connection between the elements 20 and the modules 30, as shown in FIG. 4.

Figure 7:
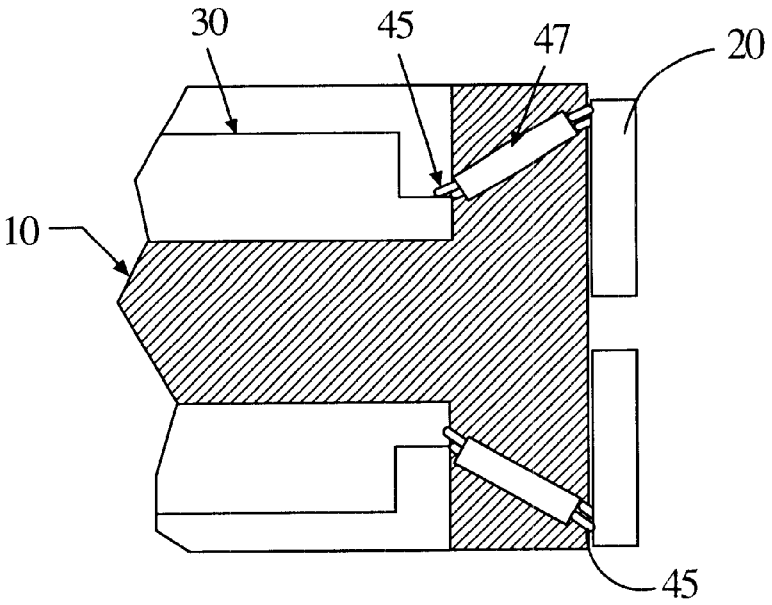
FIG. 7 is a cross-sectional view of a tray similar to that in FIG. 3, showing a second embodiment of the interconnect device.
Figure 8:
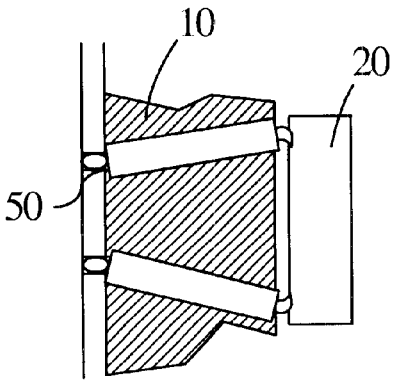
FIG. 8 is a plan view of a tray similar to that in FIG. 3, showing the second embodiment of the interconnect device.

A second embodiment of the interconnect device may be formed without the use of the outer conducting tube 43, as shown in FIGS. 7 and 8. Instead, the wire 45 and insulated coating 47 are located within a hole 50 in the tray 10, see FIGS. 7 and 8. Together the hole 50, wire 45 and insulation 47 form the interconnect. Hole 50 is preferably drilled into tray 10; however, any hole forming procedure capable of creating a smooth passage of relatively precise size is acceptable. The outside diameter of the insulation 47 is sufficiently less than the inside diameter of the hole or bore 50 in order to permit easy insertion and removal of the wire. The bore 50 and the insulation 47 have the same relationship as the tube 43 and insulation 47, as shown in FIG. 2. The conductive enclosure provided by tube 43 has been replaced by passage 50 in the tray 10, as shown in FIGS. 7 and 8. As described above, the tray 10 is preferably formed from a strong light weight conductor, such as aluminum, beryllium-berylliumoxide or aluminum-beryllium.

Figure 9:
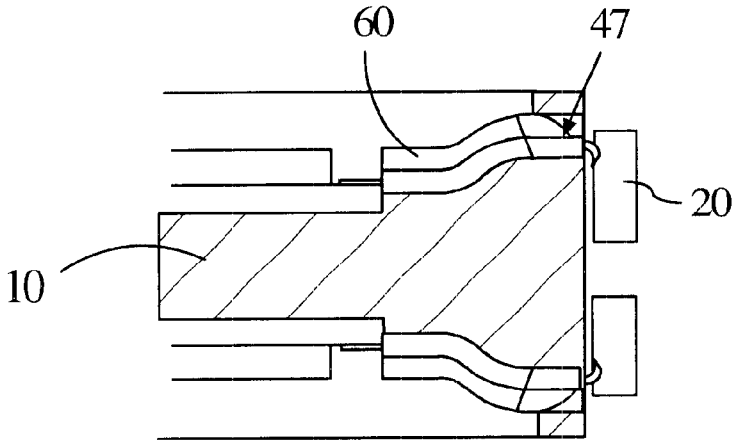
FIG. 9 is a cross-sectional view of a tray similar to that in FIG. 3, showing a third embodiment of the interconnect device.
Figure 10:
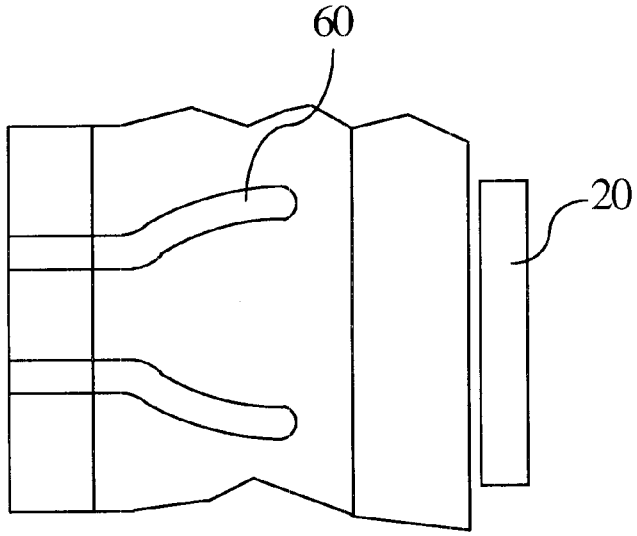
FIG. 10 is plan view of a tray similar to that in FIG. 3, showing the third embodiment of the interconnect device.

A third embodiment of the interconnect device is formed by placing a dielectric coated wire 45 into a slot or channel 60 in the tray 10, as shown in FIGS. 9 and 10. As with the second embodiment, no outer tube 43 is required. The depth of the slot 60 may vary. The depth of slot 60 may be approximately twice the diameter of the insulated coating 47, as shown in FIG. 9. Alternatively, slot 60 may be shallower and a cover (not shown) placed over the trench to form an enclosure around wire 45. Slot 60 may be formed in a variety of different shapes and sizes depending on the type and the configuration of the components to be connected and the available tooling, e.g., polygonal or elliptical in cross-section.

The design of interconnect 40 facilitates a novel method of constructing a phased array system. This method includes providing a housing or support tray 10, such as the one depicted in FIG. 3. The tray 10 is configured as necessary to receive the various components of the system, such as the antenna elements 20, the modules 30 and the interconnect devices 40. The tray configuration may include, for example, ridges 13, 15 to support interconnect devices. When the interconnect devices take the form of an alternative embodiment, the required holes 50 or slots 60 are created prior to attaching the various components to the tray 10. After the tray is provided, the antenna elements 20, modules 30 and outer tubes 43 are secured to the housing or support tray 10. The tube 43 may be secured to the housing by brazing or other suitable process.

Preferably, after the tube 43 is secured to the housing, the insulated wire 45 may be inserted into the tube. The wire 45 may be connected to the antenna element 20 and module using a soldering process. Alternatively, when a gold wire is employed a thermo-compression weld bonding process may be employed. The wire 45 may be attached to a microstrip in contact with the component to be connected. In addition, a conductive tab may be used on the end of the wire 45 to facilitate attachment to the components.

Figure 11:
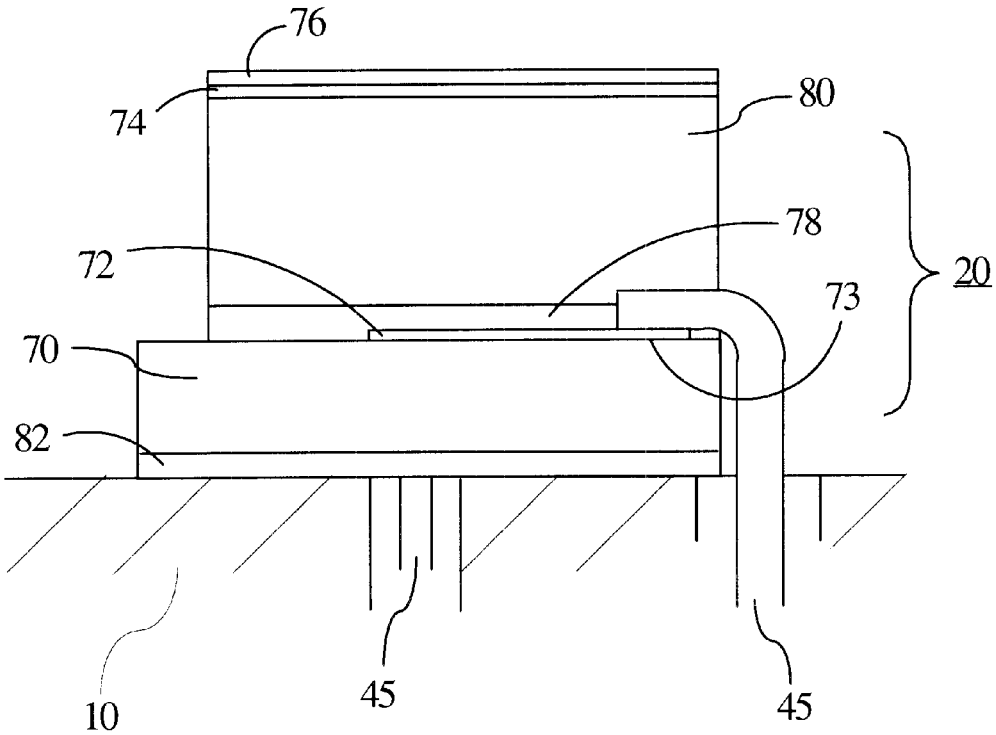
FIG. 11 is a cross-sectional view in elevation depicting the connection between an interconnect device according to the present invention and an antenna element of a phased array system.
Figure 12:
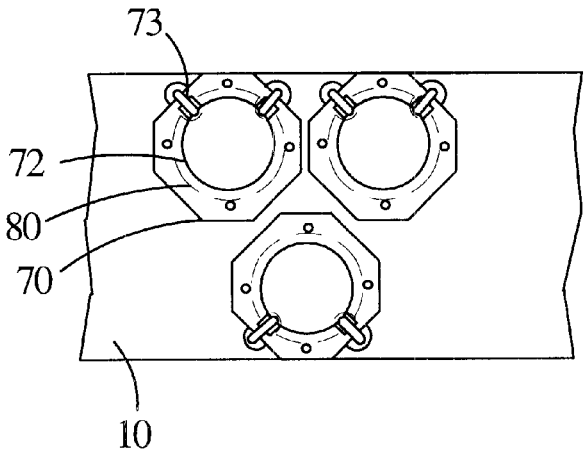
FIG. 12 is an end view in elevation of the antenna elements of FIG. 11 showing the connection between several antenna elements and several interconnect devices.

The interconnect may be connected to the antenna element 20 in any suitable manner. This connection might include for example, a microstrip line as shown in FIGS. 11 and 12. By way of example, a typical antenna element 20 including active and parasitic components is disclosed in FIG. 11. Element 20 may include a substrate 70 overlying the housing 10 and secured thereto by a suitable conventional adhesive 82. Substrate layer 70 may be a conventional dielectric material such as ceramic and glass loaded PTFE (e.g. Rogers DUROID 6002). The adhesive layer 82 may be a pressure sensitive acrylic adhesive such as 3M Y966. Partially overlying the substrate is an active patch 72 of a conductor layer, typically copper. The active patch includes a microstrip line 73. The microstrip facilitates the connection between the conducting wire 45 and the active element of the antenna. The wire 45 may be soldered to the microstrip 73. Also overlying the substrate is a foam spacer 80, which may be any suitable conventional material, exhibiting a low dielectric constant such as a rigid methacrylimide foam. The spacer 80 may be bonded to the substrate using an adhesive layer 78. Similar to the lower adhesive layer 82, layer 78 may be formed from 3M Y933. Overlying the spacer 80 is a parasitic patch of conducting material 76. The element 20 may further include an adhesive layer 74 to connect the patch 76 to the spacer 80. The adhesive layer 74 may be any suitable adhesive layer including bonding films such as ARLON 6700 CuClad 6250 thermoplastic or 3M Y966 acrylic.

Figure 13:
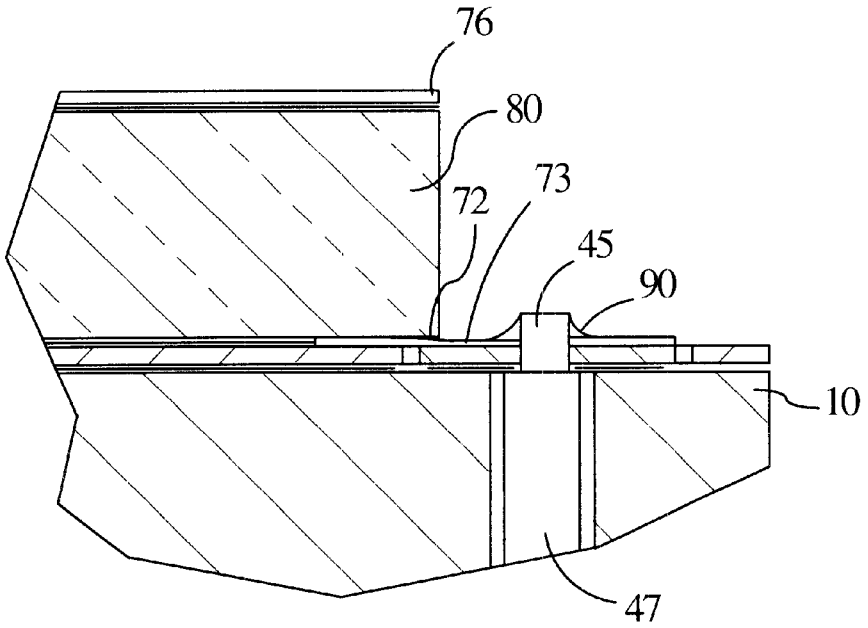
FIG. 13 is a cross-sectional view in elevation depicting the connection between an interconnect device that includes a tab attached to the conducting wire and an antenna element of a phased array system.
Figure 14:
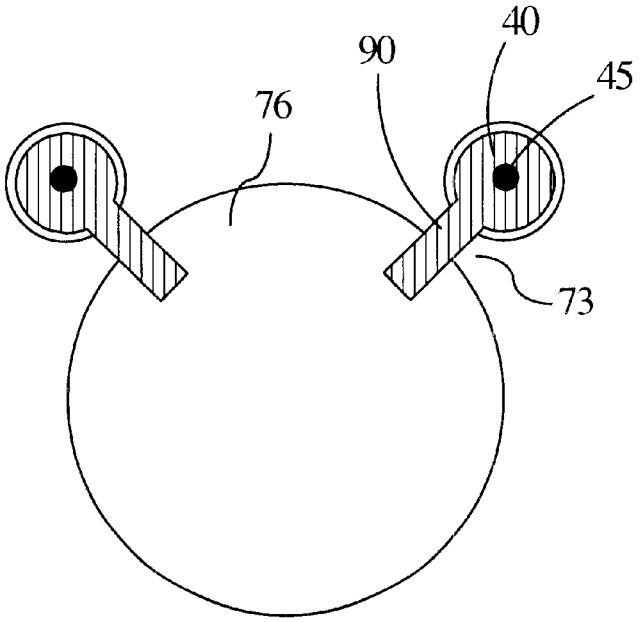
FIG. 14 is a plan view of the device depicted in FIG. 13.

The three embodiments of the present invention discussed above, may be further modified to include a conductive tab 90 to connect the microstrip 73 of the active patch 72 to the wire 45, as shown in FIGS. 13 and 14. During construction of the antenna structure the tab 90 is aligned with microstrip 73 and soldered in place. A Sn62/Pb36/Ag2 solder preform coated with 1 percent RMA may be utilized during the soldering process. The use of resistance soldering equipment is preferred. The soldering may take place without damage to the substrate. An 800 msec reflow may be utilized without causing damage to the dielectric substrate 70. Furthermore, use of a titanium thermode may minimize indentation in the copper patch 72.

While, the figures depict the use of the interconnect between antenna elements and modules, the interconnect device may support interface between many different components. For example, the interconnect may be used to make the following connections: module to module, module to substrate, module to connector, module to element, substrate to connector, substrate to element, connector to element.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A lightweight interconnect device for carrying RF and microwave signals between pairs of components, said interconnect device comprising:

an outer conducting tube, the position of one end of said tube being variable in three dimensions from the position at the other end of said tube;

a conducting wire disposed within said tube; and a layer of dielectric material coating said conducting wire, the outside dimensions of the dielectric material being sufficiently less than the inside dimensions of the conducting tube so that the dielectric coated wire is easily slidable into and out of said tube when installation or replacement of the wire is required.

2. The device of claim 1, wherein said conducting tube comprises copper.

3. The device of claim 1, wherein said dielectric material comprises polytetraflouroethylene.

4. The device of claim 1, wherein said conducting tube has a substantially circular cross section.

5. The device of claim 4, wherein said conducting tube has an outside diameter of between about 31–37 mils.

6. The device of claim 4, wherein said conducting tube has an inside diameter of between about 23–29 mils.

7. The device of claim 4, wherein said dielectric layer has an outside diameter of between about 18–22 mils.

8. The device of claim 4, wherein said conducting wire has a diameter of between about 6–10 mils.

9. The device of claim 4, wherein the longitudinal axis of said dielectric coated wire is not coaxial with the longitudinal axis of said conducting tube.

10. The device of claim 1, wherein said conducting wire comprises gold.

11. The device of claim 1, wherein said conducting wire comprises copper.

12. The device of claim 1, further comprising a tab connected to at least one end of said conducting wire to facilitate attachment to the components.

13. The device of claim 1, wherein said interconnect device is capable of carrying communication signals with a frequency greater than 20 GHz.

14. An interconnect for connecting components of a phased array RF system comprising:

a tube shaped outer enclosure; and a flexible insulated wire, the diameter of said wire being sufficiently less than the internal diameter of said outer enclosure so that said flexible wire is freely departable from the axis of said outer enclosure without binding against said outer enclosure when the axis of said outer enclosure deviates from a straight line in the connection of the components to be connected, thereby improving the replacability of the wire.

15. In a system that carries RF signals that includes a plurality of components to be connected and a plurality of interconnect devices for establishing an electrical connection between the components, the density of the components being limited by the size and arrangement of interconnect devices, the improvement wherein each of said plurality of interconnect devices comprises a respective rigid conducting tube with a corresponding flexible insulated wire disposed therein, said respective wire being loosely disposed in said corresponding tube allowing for easy insertion into and removal from said corresponding tube, the axis of said respective tube and said corresponding wire departing from a line between the components to be connected thereby allowing the density of the components to increase.

16. In a phased array antenna structure including an antenna element, an electronic module, and an interconnect between the antenna element and the module, the antenna element, the module and the interconnect secured to a housing structure, the improvement wherein the interconnect comprises a non-linear rigid conducting tube and a flexible dielectric coated conducting wire disposed in said tube, said wire and said tube being in a sloppy coaxial arrangement, thereby allowing said wire to be replaced without disassembling the interconnect from the housing.

17. An interconnect device for connecting components of a system carrying RF or microwave signals, the components being mounted in a conductive housing, said device comprising:

a connecting passage in the housing extending between the components to be connected;

a flexible conducting wire within said passage; and a layer of dielectric material coating said conducting wire, the outside dimensions of said layer of dielectric material being sufficiently less than the inside dimensions of said passage so that said dielectric coated wire is easily removable when replacement is required.

18. The device of claim 17, wherein said passage comprises a hole in the housing.

19. The device of claim 17, wherein said passage comprises a slot in the housing.

20. The device of claim 17, wherein said passage comprises a rigid conducting tube attached to the housing.

21. An interconnect device for connecting components of a system carrying RF signals, the components being mounted in a plurality of conductive trays, said device comprising:

at least one trench disposed within each of said plurality of conducting trays and extending between the components to be connected;

a conducting wire within said at least one trench;

a layer of dielectric material coating said conducting wire; and a conductive cover overlying said at least one trench creating an enclosure for said dielectric coated wire, the outside dimensions of the said layer of dielectric material being sufficiently less than the inside dimensions of said enclosure so that said dielectric coated wire may be easily removed from said enclosure when replacement is required.

22. The device of claim 21, wherein cross-sectional shape of said enclosure is a polygon.

23. The device of claim 21, wherein the cross-sectional shape of the enclosure is elliptical.

24. In a method of constructing a phased array communication system, the system including antenna elements and electronic modules installed in a housing and a plurality of interconnect devices for connecting the elements and modules together, each interconnect device including a respective conducting tube containing a corresponding flexible dielectric coated wire, each interconnect device extending between an antenna element and an electronic module to be connected, the improvement comprising the step of reducing the diameter of the respective dielectric coated wire sufficiently so that the respective wire is movable within the corresponding tube thereby allowing the respective tube to be installed in the housing prior to the respective wire being inserted into the corresponding tube.

25. A method of assembling a phased array antenna structure comprising the steps of:

(a) providing a housing;

(b) installing an antenna element in the housing;

(c) installing an electronic module in the housing;

(d) establishing a connection between the antenna element and the electronic module using an interconnect device, the interconnect device assembly process including the following steps:

(1) providing a rigid conductive enclosure between the antenna element and the electronic module; and (2) inserting a dielectric coated conductive wire into the enclosure.

26. The method of claim 25, wherein the step of providing a conductive enclosure comprises the step of drilling a hole in the housing.

27. The method of claim 25, wherein the step of providing a conductive enclosure includes providing a slot in the housing.

28. The method of claim 27, further comprising covering the slot after the dielectric coated wire is placed in the slot.

29. The method of claim 25, wherein the step of providing a conductive enclosure comprises providing a conductive tube.

30. The method of claim 29, further comprising connecting the tube to the housing.

31. The method of claim 30, wherein the step of connecting the conductive tube to the housing comprises brazing.

32. The method of claim 30, wherein the step of inserting the dielectric coated wire is accomplished after the step of connecting the tube to the housing.

33. The method of claim 25, further comprising the step of connecting the wire to the element and module.

34. The method of claim 33, wherein the step of connecting the wire comprises soldering.

35. The method of claim 33, wherein the step of connecting the wire comprises weld bonding.

36. The method of claim 33, wherein the step of connecting the wire comprises a thermo-compression process.

37. The method of claim 33, wherein the step of connecting the wire includes attaching the wire to a microstrip of the antenna element.

38. The method of claim 33, wherein the step of connecting the wire includes attaching a conductive tab to one end of the wire.

39. An interconnect device for components of a RF signal system comprising:

means defining an electrically conductive passageway; and a flexible electrically insulated conductive wire disposed interiorly of said passageway, the external dimensions of said insulated wire being sufficiently small relative to the internal dimension of said passageway so that the insulated wire is easily slidable into and out of said passageway when installation or replacement of the wire is required.

40. The interconnect device of claim 39 wherein said means defining a passageway is a tube.

41. The interconnect device of claim 39 wherein said means defining a passageway comprises a conductive tray having a trench shaped to receive said insulated wire and a conductive cover overlying said trench.

42. The interconnect device of claim 41 wherein said tray has components of an RF signal system mounted therein.

43. The interconnect device of claim 39 wherein the components include elements of a phased array antenna system comprising electronic modules and antenna elements.

* * * * *